US008641458B2

(12) United States Patent
Matsumura et al.

(10) Patent No.: US 8,641,458 B2
(45) Date of Patent: Feb. 4, 2014

(54) CONNECTOR HAVING LOCKING LANCE WITH LANCE BEAK PART AND LOCKING PROJECTION

(75) Inventors: Kaoru Matsumura, Makinohara (JP); Tomoyoshi Fukaya, Makinohara (JP); Kenji Kajikawa, Fujieda (JP)

(73) Assignee: Yazaki Corporation, Tokyo (JP)

( * ) Notice: Subject to any disclaimer, the term of this patent is extended or adjusted under 35 U.S.C. 154(b) by 71 days.

(21) Appl. No.: 13/393,381

(22) PCT Filed: Oct. 1, 2010

(86) PCT No.: PCT/JP2010/067699

§ 371 (c)(1),
(2), (4) Date: Feb. 29, 2012

(87) PCT Pub. No.: WO2011/040649

PCT Pub. Date: Apr. 7, 2011

(65) Prior Publication Data

US 2012/0156945 A1 Jun. 21, 2012

(30) Foreign Application Priority Data

Oct. 1, 2009 (JP) ..... 2009-229573

(51) Int. Cl.
*H01R 13/514* (2006.01)

(52) U.S. Cl.
USPC ..... 439/752; 439/595

(58) Field of Classification Search
USPC ..... 439/752, 752.5, 595
See application file for complete search history.

(56) References Cited

U.S. PATENT DOCUMENTS

| | | | | |
|---|---|---|---|---|
| 6,186,806 | B1 | 2/2001 | Suzuki et al. | |
| 6,261,115 | B1 | 7/2001 | Pederson et al. | |
| 6,290,521 | B1 | 9/2001 | Suzuki et al. | |
| 6,375,503 | B2 * | 4/2002 | Ohsumi | 439/595 |
| 6,551,145 | B2 * | 4/2003 | Kurimoto et al. | 439/752 |

(Continued)

FOREIGN PATENT DOCUMENTS

| | | | |
|---|---|---|---|
| EP | 1045482 | A2 | 10/2000 |
| JP | 2000311748 | A | 11/2000 |
| JP | 2001185275 | A | 7/2001 |
| JP | 2005166607 | A | 6/2005 |

OTHER PUBLICATIONS

International Search Report dated Dec. 15, 2010 in counterpart international application No. PCT/JP2010/067699.

(Continued)

*Primary Examiner* — Hae Moon Hyeon
(74) *Attorney, Agent, or Firm* — Sughrue Mion, PLLC

(57) ABSTRACT

To provide a connector in which a lance beak part will not be broken, even though a large load is applied by a front holder. A locking lance is provided, at its distal end, with a lance beak pad which is adapted to be caught by a lock releasing jig for releasing lock of the locking lance with respect to a terminal, and a locking projection which is continued from the lance beak part and erected from a terminal end of the lance beak part. When a projected part is inserted into e deflection space in a state where the locking lance is deflected, a lower face of the projected part overrides an upper face of the lance beak part, and a distal end of the projected part comes into contact with a vertical face of the locking projection which is erected from the lance beak part.

3 Claims, 10 Drawing Sheets

(56) References Cited

U.S. PATENT DOCUMENTS

| | | | | |
|---|---|---|---|---|
| 6,682,359 | B1 | 1/2004 | Hitchcock et al. | |
| 6,863,568 | B2 * | 3/2005 | Nakamura | 439/595 |
| 7,066,773 | B1 * | 6/2006 | Martin | 439/752 |
| 7,112,104 | B2 * | 9/2006 | Sagawa et al. | 439/752 |
| 7,281,961 | B1 * | 10/2007 | Sugiyama et al. | 439/752 |
| 2001/0006861 | A1 | 7/2001 | Ohsumi | |
| 2002/0072277 | A1 * | 6/2002 | Tanaka | 439/752 |
| 2004/0203287 | A1 * | 10/2004 | Itou et al. | 439/595 |
| 2005/0085127 | A1 | 4/2005 | Maeda | |
| 2006/0035536 | A1 * | 2/2006 | Sai | 439/752 |
| 2012/0309219 | A1 * | 12/2012 | Hiraishi | 439/352 |

OTHER PUBLICATIONS

Written Opinion dated Dec. 15, 2010 in counterpart international application No. PCT/JP2010/067699.

* cited by examiner

DETAILS OF REGION C

CONNECTOR HAVING LOCKING LANCE WITH LANCE BEAK PART AND LOCKING PROJECTION

TECHNICAL FIELD

The present invention relates to a connector in which incomplete insertion of a terminal inside a connector housing can be detected, in case where a locking lance for locking the terminal is deflected due to the incompletely inserted state of the terminal, by butting a projected part of a front holder against the locking lance, and on the other hand, in case where the locking lance is not deflected due to a completely inserted state of the terminal, the deflection of the locking lance can be restricted by the projected part.

BACKGROUND ART

Examples of the connector of the above described type are disclosed, for example, in the following Patent Literature (PTL) 1 to 3.

FIGS. 7A to 10 show an example of the conventional connector of the above described type. FIG. 7A shows a connector housing 10, FIG. 7B shows a front holder 20, and FIG. 7C shows the front holder 20 in a state fitted to the connector housing 10, respectively in sectional views.

This connector housing 10 is provided with a terminal containing room 11 which has an opening at a backward side, and a terminal 12 equipped with an electric wire (See FIG. 8) is adapted to be inserted into the terminal containing room 11 through this opening. The front holder 20 is inserted and fitted to an engaging front end side of the connector housing 10. The terminal 12 has, at its distal end, a base plate portion 12*b* to be contacted with a mating terminal (not shown), and a catch portion 12*a* which is positioned at a back end of the base plate portion 12*b* and adapted to be locked by a locking lance 13, which will be described below.

The locking lance 13 having flexibility is provided inside the terminal containing room 11 of the connector housing 10, in such a manner that a locking projection 14 of the locking lance 13 projects into the terminal containing room 11 in a free state of the locking lance 13. When the terminal 12 is inserted into the terminal containing room 11, the locking projection 14 of the locking lance 13 is brought into contact with the base plate portion 12*b* and deflected. Then, the terminal 12 is further inserted into deep, and the locking projection 14 passes the base plate portion 12*b* to be restored into a not-deflected state. When the locking projection 14 which has been restored into the not-deflected state is engaged with the catch portion 12*a* of the terminal 12, the terminal 12 is secured in the terminal containing room 11. The state where the locking projection 14 of the locking lance 13 is engaged with the catch portion 12*a* of the terminal 12 and the locking lance 13 is not deflected, as described above, is called as a completely inserted state of the terminal.

As shown in FIG. 7B, the front holder 20 includes a frame-like part 7 in a shape of a substantially rectangular frame having a front end wall 8, and slides in a direction opposite to an insertion direction of the terminal 12 to be engaged with the connector housing 10. Moreover, a projected part 9 in a shape of a thin plate is formed inside the frame-like part 7 so as to project from the front end wall 8 in a longitudinal direction of the housing. When the front holder 20 is engaged with the connector housing 10 in the completely inserted state of the terminal 12, the projected part 9 is guided by an insertion part 17 in a shape of a hole or groove, and inserted into the connector housing 10. Then, the projected part 9 is inserted into a deflection space 16 which is formed below the locking lance 13 for allowing deflection of the locking lance 13. In case where the terminal 12 is in the completely inserted state, the projected part 9 enters into the deflection space 16 without coming into contact with the locking lance 13, and restricts the deflection of the locking lance 13. In this manner, it is possible to prevent the terminal 12 from being accidentally released from the lock by the locking lance 13 to be withdrawn from the terminal containing room 11.

On the other hand, FIG. 9 shows a state where the locking projection 14 of the locking lance 13 is brought into contact with the base plate portion 12*b* and deflected, when the terminal 12 is inserted into the terminal containing room 11. Although the state where the locking projection 14 of the locking lance 13 is engaged with the catch portion 12*a* of the terminal 12 is called as the completely inserted state of the terminal, the state where the locking lance 13 is deflected and the locking projection 14 of the locking lance 13 is not engaged with the terminal 12 is called as an incompletely inserted state of the terminal 12. In the incompletely inserted state of the terminal, the locking lance 13 is deflected toward the deflection space 16 which is formed in the connector housing 10. For this reason, when the front holder 20 is engaged with the connector housing 10 in which the terminal 12 is in the incompletely inserted state, a distal end of the projected part 9 comes into contact with a distal end face of a lance beak part 13*a* which is positioned at a distal end of the deflected locking lance 13, and relatively thin and long, and the front holder 20 can be no longer pushed in. A worker recognizes that the terminal 12 is in the completely inserted state or in the incompletely inserted state, by sensing whether or not the front holder 20 can be pushed in. When the worker has detected that the terminal is in the incompletely inserted state, the worker pushes the terminal 12 again into the terminal containing room 11 so that the terminal 12 may be brought into the completely inserted state.

CITATION LIST

Patent Literature

[PTL 1] JP-A-2000-311748
[PTL 2] JP-A-2001-185275
[PTL 3] JP-A-2005-166607

SUMMARY OF INVENTION

Technical Problem

As described above, the conventional connector has such a structure that in case where the terminal 12 is in the incompletely inserted state, the projected part 9 provided in the front holder 20 is brought into contact with the distal end of the deflected locking lance 13, as understood from FIGS. 9 and 10. However, it is considered that the worker cannot grasp from a feeling transmitted from the front holder 20, depending on degree of his learning, how deep the front holder 20 should be pushed in, in order to obtain the completely inserted state. The worker having such a low degree of learning keeps on pushing in the front holder 20, even after the projected part 9 has come into contact with the locking lance 13. As the results, there is such anxiety that an excessive load is applied to the distal end of the locking lance 13, and the distal end may be broken.

Another factor of likeliness to break the distal end of the locking lance 13 is presence of the lance beak part 13*a* which is formed at the distal end of the locking lance 13, and relatively thin and long. The lance beak part 13*a* is a part to be caught by a lock releasing jig which is inserted into the terminal containing room 11 from the front end wall 8 of the front holder 20, for the purpose of releasing the lock of the locking lance 13 with respect to the catch portion 12*a* of the terminal 12, thereby to withdraw the terminal 12 from the terminal containing room 11. In case where the terminal 12 is in the completely inserted state, a tip end of the lock releasing jig is engaged with the lance beak part 13*a*, and in this state, the lock releasing jig is pushed down in a direction of deflecting the locking lance 13, thereby to release the lock of the locking lance 13 with respect to the catch portion 12*a* of the terminal 12. The lance beak part 13*a* has a smaller width and thickness as compared with a thickness of the locking lance 13 (a length in a vertical direction in FIG. 10) at a position where the locking projection 14 is provided, so that the tip end of the lock releasing jig can be easily engaged with the lance beak part 13*a*. A step difference is formed between the locking projection 14 and the lance beak part 13*a*. Therefore, when the projected part 9 is brought into contact with the distal end of the locking lance 13, particularly, the lance beak part 13*a*, and an excessive load is applied, there is such anxiety that an external force is concentrated on the lance beak part 13*a* which has the smaller width and thickness as compared with the part where the locking projection 14 is provided, and the lance beak part 13*a* may be broken.

In case where the lance beak part 13*a* positioned at the distal end of the locking lance 13 has been broken, as described above, it is difficult for the tip end of the lock releasing jig to be engaged with the locking lance 13. Further, once the part which has been broken and detached from a main body of the locking lance 13 has entered in the deflection space 16 below the locking lance 13, the locking lance 13 becomes unable to be deflected any more, for the purpose of releasing the lock of the locking lance 13 with respect to the catch portion 12*a*.

The invention has been made in view of the above described circumstances, and it is an object of the invention to provide a connector in which a lance beak part is restrained from being broken, even though a large load is applied to a front holder which is going to be engaged with a connector housing, in an incompletely inserted state of a terminal.

Solution to Problem

In order to attain the above described object, the connector according to the invention features the structure as described in the following items (1) to (3).

(1) A connector, comprising a connector housing having a flexible locking lance that locks a terminal to be inserted in the connector housing, and a deflection space that allows deflection of the locking lance; and a front holder having a projected part that is inserted into the deflection space in a direction opposite to the insertion direction of the terminal, wherein an distal end of the locking lance is provided with a lance beak part adapted to be caught by a lock releasing jig that releases the lock of the locking lance with respect to the terminal, the lock releasing jig being to be inserted into the front holder in a direction opposite to the insertion direction of the terminal, and a locking projection that is continued from the lance beak part and erected from a terminal end of the lance beak part; and wherein when the projected part is inserted into the deflection space in a state where the locking lance is deflected, a lower face of the projected part overrides an upper face of the lance beak part, and a distal end of the projected part comes into contact with a vertical face of the locking projection which is erected from the lance beak part.

(2) The connector as described in (1), wherein an inclined face which is tapered toward the distal end of the locking lance is formed on the upper face of the lance beak part, and an inclined face which is tapered toward the distal end of the projected part is formed on the lower face of the projected part.

(3) The connector as described in (2), wherein when the lower face of the projected part overrides the upper face of the lance beak part, the lower face of the projected part is brought into face contact with the upper face of the lance beak part.

According to the structure as described in the above item (1), because the projected part strikes the locking projection which is more rigid due to its large wall thickness, the distal end of the locking lance can be restrained from being broken, as compared with the case where the projected part strikes the lance beak part. Therefore, it is possible to provide the connector having such a structure that the lance beak part will not be broken, even though a large load is applied by the front holder.

According to the structure as described in the above item (2), because the lower face of the projected part slides along the upper face of the lance beak part and overrides the upper face of the lance beak part, the distal end of the projected part can be guided to the vertical face of the locking lance, while an external force to be exerted on the lance beak part when the projected part strikes the lance beak part is depressed. In this manner, it is possible to restrain the lance beak part from being broken.

According to the structure as described in the above item (3), because the lower face of the projected part slides along the upper face of the lance beak part in face contact with each other and overrides the upper face of the lance beak part, an external force to be exerted on the lance beak part, when the projected part strikes the lance beak part, can be depressed to the least.

Advantageous Effects of Invention

According to the connector of the invention, it is possible to restrain the lance beak part from being broken, even though a large load is applied to the front holder which is going to be engaged with the connector housing, in case where the terminal is in the incompletely inserted state.

The invention has been briefly described hereinabove. Details of the invention will be further made clear, by reading through the mode for carrying out the invention which will be described below, referring to the attached drawings.

BRIEF DESCRIPTION OF DRAWINGS

FIGS. 1A to C show a preferred embodiment of the connector according to the invention, of which FIG. 1A is a perspective view of a housing of the connector, FIG. 1B is a sectional view of the housing, and FIG. 1C is an enlarged view of a region C in FIG. 1B.

FIGS. 2A and B show the preferred embodiment of the connector according to the invention, of which FIG. 2A is a perspective view of a front holder.

FIGS. 3A to C show the preferred embodiment of the connector according to the invention, of which FIG. 3A is a perspective view of a connector assembly in which the front holder is incorporated into the housing, in a state where the holder is temporarily locked, FIG. 3B is a sectional view of the connector assembly in the temporarily locked state of the holder, and FIG. 3C is an enlarged view of a region C of the connector assembly as shown in FIG. 3B.

FIGS. 7A to C show an example of a conventional connector, of which FIG. 7A is a sectional view of a housing of the connector, FIG. 7B is a sectional view of a front holder, and FIG. 7C is a sectional view of a connector assembly in which the front holder is incorporated into the housing.

DESCRIPTION OF EMBODIMENTS

Figure 1A:
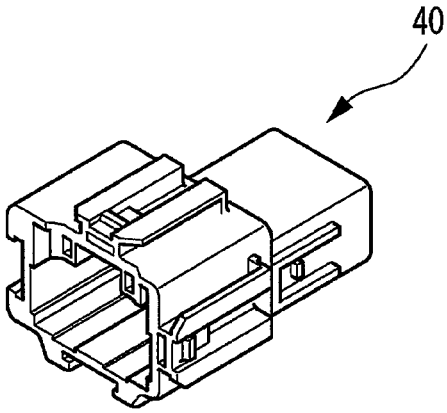
Figure 1B:
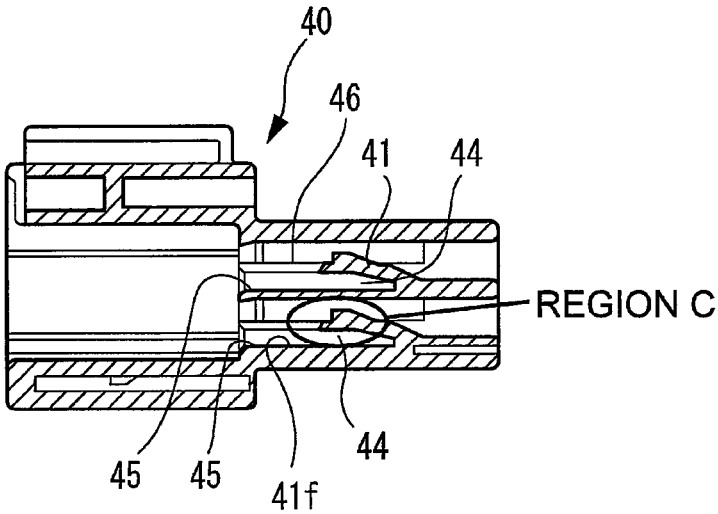

Now, referring to FIGS. 1A to 6, a preferred embodiment of the connector according to the invention will be described in detail. The invention will be described below as being applied to the conventional connector having such a design as shown in FIGS. 7A to 10. However, it is needless to say that the invention is not limited to the connector having such design, but can be applied to the connectors having various other designs. Moreover, reduction of scale in the drawings is made only for convenience, but does not represent actual relation between sizes.

As understood from FIGS. 1A to 3, a connector 30 in the preferred embodiment according to the invention includes a connector housing 40 formed of synthetic resin and having a flexible locking lance 41 for locking a terminal 12, and a front holder 50 formed of synthetic resin which is inserted and fitted to an engaging front end side of the connector housing 40.

The connector housing 40 is provided with a terminal containing room 46 which has an opening at a backward side, and a terminal 12 equipped with an electric wire (See FIG. 4) is adapted to be inserted into the terminal containing room 46 through this opening. In this terminal containing room 46, a locking lance 41 to be locked to a catch portion 12*a* of the terminal 12, for securing the terminal 12 which is contained in the terminal containing room 46, is provided so as to project upward from a lower wall face defining the terminal containing room 46. Moreover, a deflection space 44 for allowing the deflection of the locking lance 41 is formed below a free end of the locking lance 41. Further, an insertion part 45 in a shape of a hole or groove is formed in front of the deflection space 44. This insertion part 45 serves as a guide for guiding a projected part 51 which is formed in the front holder 50 to be inserted into the connector housing 40, when the front holder 50 is engaged with the connector housing 40

The front holder 50 includes a frame-like part 52 in a shape of a substantially rectangular frame having a front end wall 53, and slides in a direction opposite to an insertion direction of the terminal 12 thereby to be engaged with the connector housing 40. Moreover, the projected part 51 in a shape of a thin plate is formed inside the frame-like part 52 so as to project from the front end wall 53 in a longitudinal direction of the housing. When the front holder 50 is engaged with the connector housing 40 in the completely inserted state of the terminal 12, the projected part 51 is guided by the insertion part 45 in a shape of a hole or groove, and inserted into the connector housing 40. Then, the projected part 51 is inserted into the deflection space 44 which is formed below the locking lance 41 for allowing the deflection of the locking lance 41. On the other hand, in case where the front holder 50 is engaged with the connector housing 40 in the incompletely inserted state of the terminal 12, the distal end of the projected part 51 comes into contact with a lance beak part 43 which is formed at a distal end of the deflected locking lance 41, and relatively thin and long.

Figure 2A:
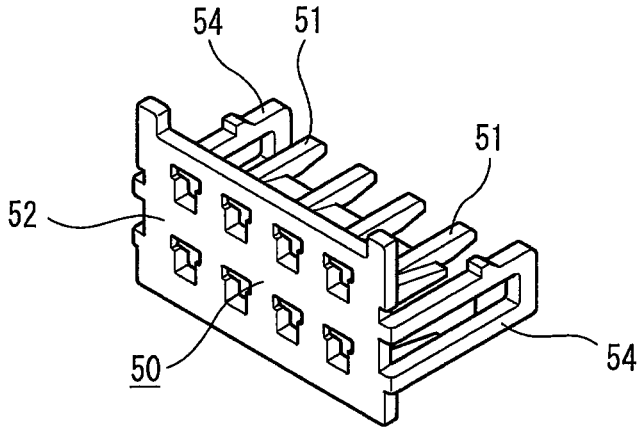
Figure 2B:
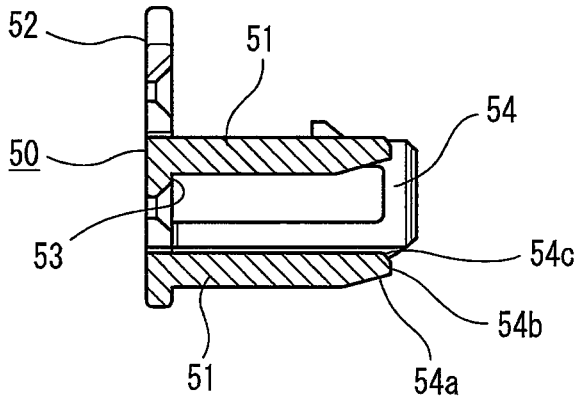
FIG. 2B is an enlarged view of a projected part of the front holder and its surroundings.

As understood from FIGS. 2A and 2B, the projected part 51 terminates slightly short of a side wall 54 of the frame-like part 52. As shown in FIG. 2B, the distal end portion of the projected part 51 is defined by a lower face 54*a* which is inclined upward toward a most distal end at an angle $\alpha$ (an inclination angle $\alpha$ tapered toward the distal end of the projected part 51. See FIG. 5), a vertical face 54*b* at the most distal end extending upward from a distal end of the lower face 54*a*, and a chamfered face 54*c* inclined in an opposite direction to the lower face 54*a* and extending from an upper end of the vertical face 54*b*. Because the lower face 54*a* of the projected part 51 is tapered in this manner, even in case where the front holder 50 is engaged with the connector housing 40 in the incompletely inserted state of the terminal 12, the lower face 54*a* of the projected part 51 is likely to override the lance beak part 43 of the locking lance 41, when the distal end of the projected part 51 comes into contact with the distal end face of the lance beak part 43 of the deflected locking lance 41.

On the other hand, the distal end portion of the flexible locking lance 41 which is provided inside the connector housing 40 has substantially the same shape as that of the conventional case as shown in FIGS. 7A to 10. The distal end portion has a locking projection 42 which is projected upward, and the lance beak part 43 which extends forward in a shape of a beak from the locking projection 42.

The lance beak part 43 is a part to be caught by a lock releasing jig which is inserted into the terminal containing room 46 from the front end wall 53 of the front holder 50, for the purpose of releasing the lock of the locking lance 41 with respect to the catch portion 12*a* of the terminal 12, thereby to withdraw the terminal 12 from the terminal containing room 46. In case where the terminal 12 is in the completely inserted state, a tip end of the lock releasing jig is engaged with the lance beak part 43, and in this state, the lock releasing jig is pushed down in a direction of deflecting the locking lance 41, thereby to release the lock of the locking lance 41 with respect to the catch portion 12*a* of the terminal 12. The lance beak part 43 has a smaller width and thickness as compared with a thickness of the locking lance 41 (a length in a vertical direction in FIG. 1C) at a position where the locking projection 42 is provided, so that the tip end of the lock releasing jig can be easily engaged with the lance beak part 43. A step difference is formed between the locking projection 42 and the lance beak part 43.

Figure 1C:
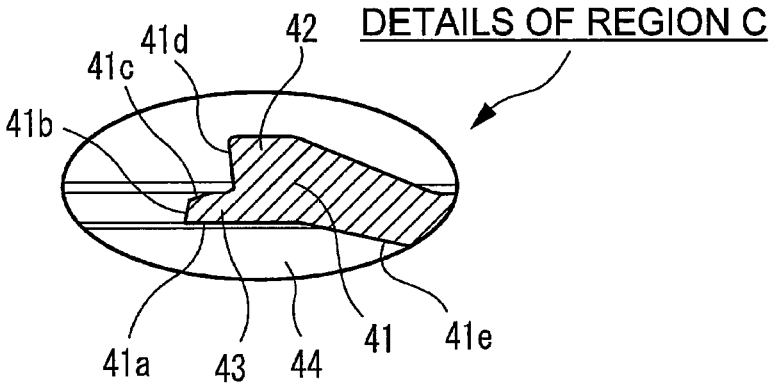
Figure 3A:
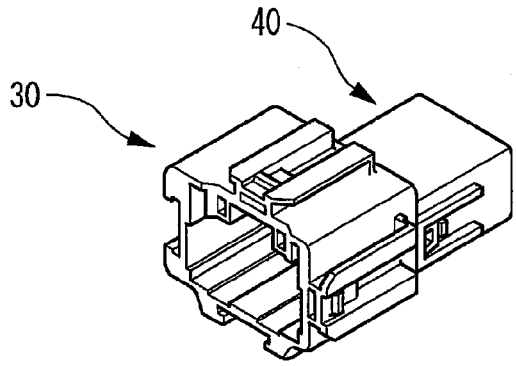
Figure 3B:
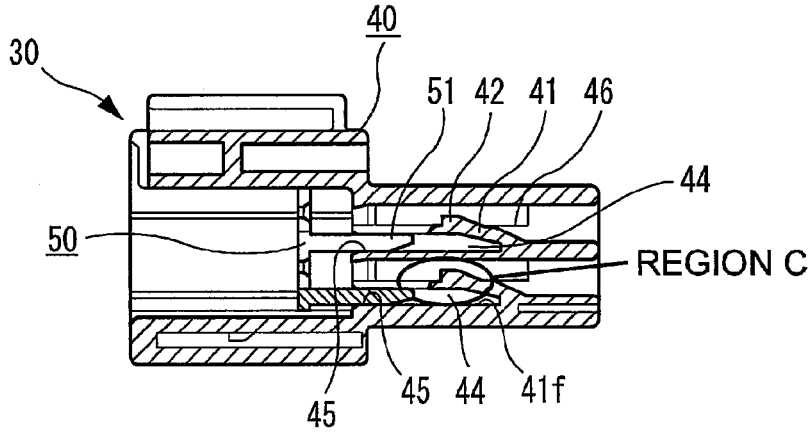
Figure 3C:
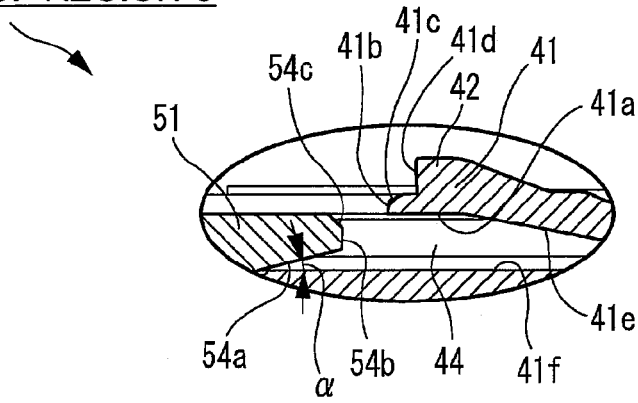

Shapes of the locking projection 42 and the lance beak part 43 will be further described in detail. As shown in FIGS. 1C and 3C, the lance beak part 43 is defined by a lower face 41*a* which extends forward substantially horizontally in a free state of the locking lance 41, an upright distal end face 41*b* which extends upward from a distal end of the lower face 41*a*, and a contact face 41*c* which extends from an upper end of the upright distal end face 41*b* at an angle corresponding to the angle $\alpha$ of the aforesaid lower face 54*a* of the projected part 51 (an inclination angle α tapered toward the distal end of the lance beak part 43. See FIG. 5), and a vertical face 41*d* which extends upward from a back end of the contact face 41*c* in a substantially vertical direction.

In this manner, the upright distal end face 41*b* is erected from the distal end of the lower face of the locking lance 41 at a side of the locking projection 42, the contact face 41*c* which is slightly inclined toward the locking projection 42 is positioned from the distal end of the upright distal end face 41*b*, and the contact face 41*c* is continued to the vertical face 41*d* which is erected. On the other hand, the lower face 41*a* of the lance beak part 43 is continued to an inclined inner wall face 41*e* which is a lower face of a main body of the locking lance 41, at a position remote from a region of the locking projection 42, and turned back at a root of the locking lance 41 to be continued to another inner wall face 41*f*.

A region enclosed by the inclined inner wall face 41*e* and the inner wall face 41*f* defines the deflection space 44 for allowing the deflection of the locking lance 41. Moreover, the insertion part 45 in a shape of a hole or groove is formed at a front end side of the connector housing 40 so as to communicate with this deflection space 44. This insertion part 45 serves as a guide for guiding the projected part 51, which is formed in the front holder 50, to be inserted into the connector housing 40, when the front holder 50 is engaged with the connector housing 40.

A front end wall 47 of the terminal containing room 46 of the connector housing 40 is provided with an insertion hole 47*a* for allowing a mating terminal (not shown) to pass through. The front end wall 47 is continued to partition walls 48*a* for separating a plurality of the terminal containing rooms 46 which are positioned right and left, above and below, and an outer wall 48*b* which defines an outer shape at a back side of the connector housing 40. Each of the partition walls 48*a* is continued from the insertion hole 47*a*, and the outer wall 48*b* surrounds a plurality of the terminal containing rooms 46.

Figure 4:
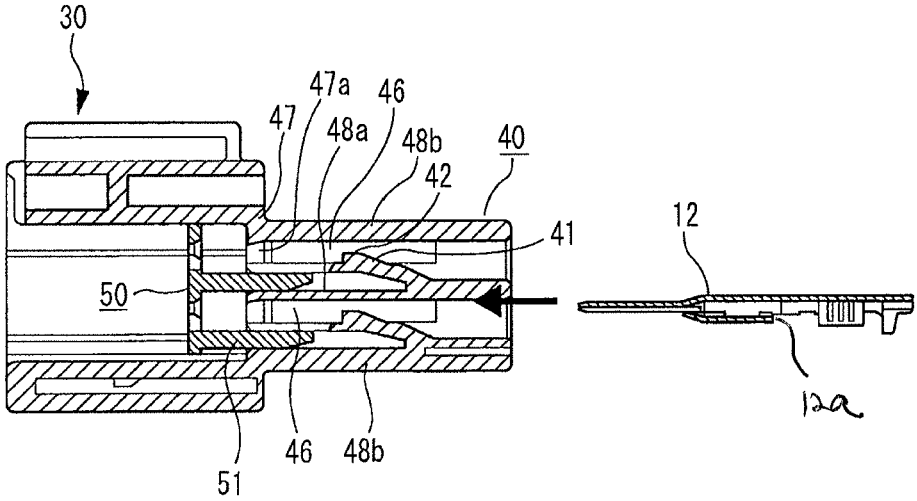
FIG. 4 is a sectional view showing a state before a terminal is inserted into the connector assembly.

Then, assembling steps of the terminals 12, the connector housing 40 and the front holder 50 will be described. As a first step, the terminals 12 are inserted into the terminal containing rooms 46 in the connector housing 40, as shown in FIG. 4. On this occasion, all the terminals 12 which have been inserted into the terminal containing rooms 46 are preferably in the completely inserted state, but some of the terminals 12 may be in the incompletely inserted state. Then, the front holder 50 is pushed into the connector housing 40 in the direction opposite to the inserting direction of the terminals. On this occasion, the projected parts 51 of the front holder 50 are guided by the insertion parts 45 in the connector housing 40, to be introduced into the terminal containing rooms 46 inside the connector housing 40.

In case where the terminal 12 is in the completely inserted state, the projected part 51 which is introduced into the terminal containing room 46 is inserted into the deflection space 44 which is formed below the locking lance 41 thereby to restrict deflection of the locking lance 41. In this manner, it is possible to prevent the terminal 12 from being accidentally released from the lock by the locking lance 41, thereby to be withdrawn from the terminal containing room 46.

Figure 5:
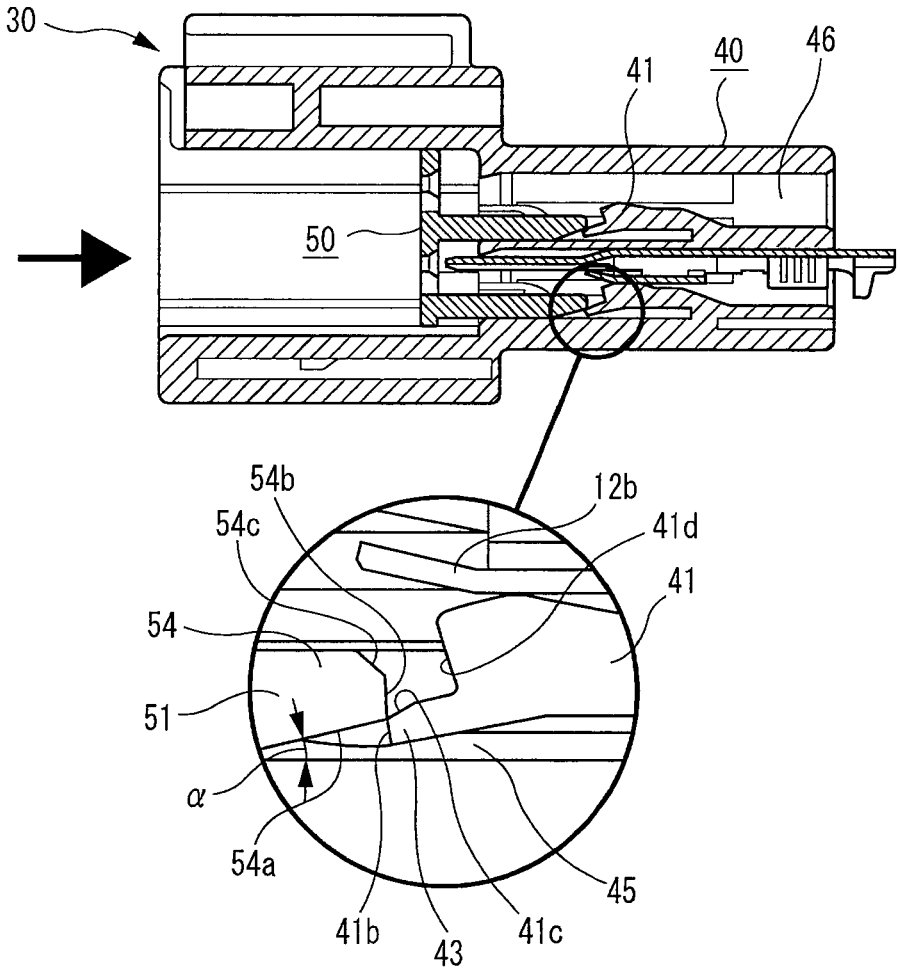
FIG. 5 is a sectional view showing a state where the terminal is incompletely inserted into the connector assembly.
Figure 6:
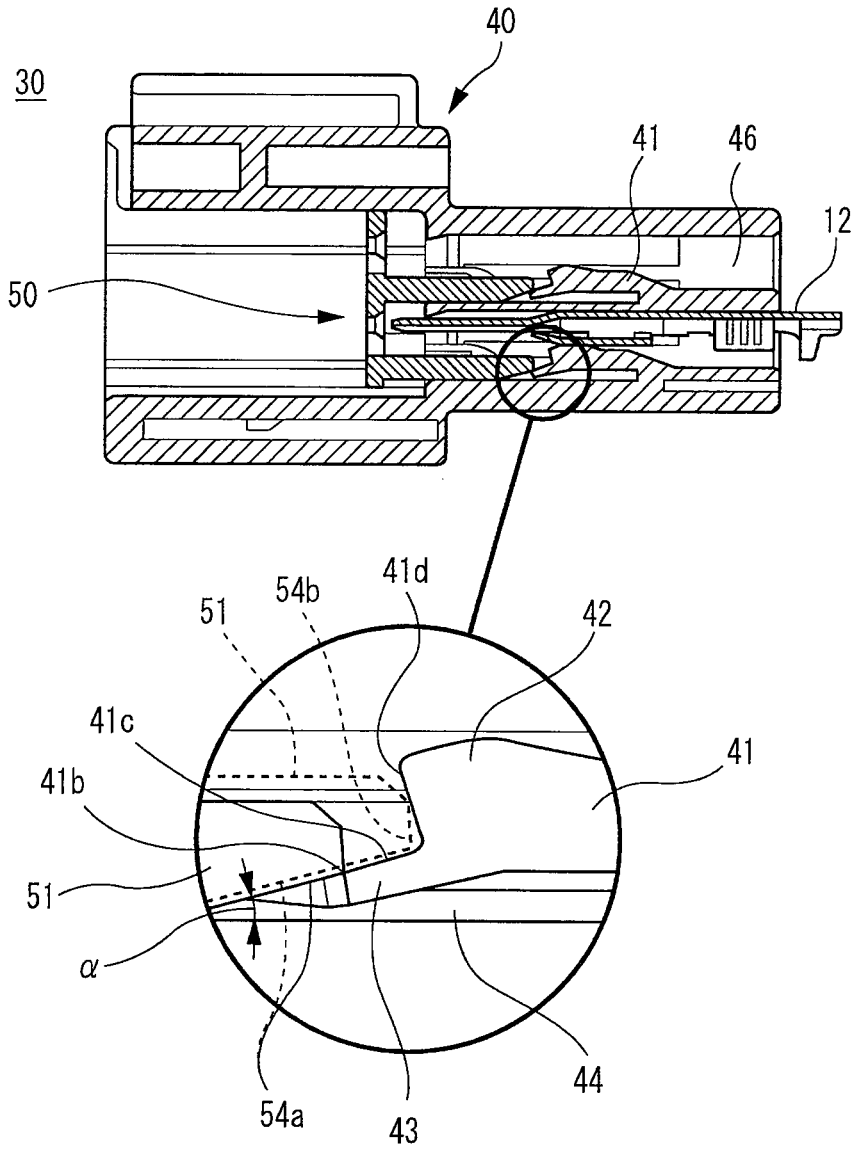
FIG. 6 is a sectional view showing another state where the terminal is incompletely inserted into the connector assembly.
Figure 7A:
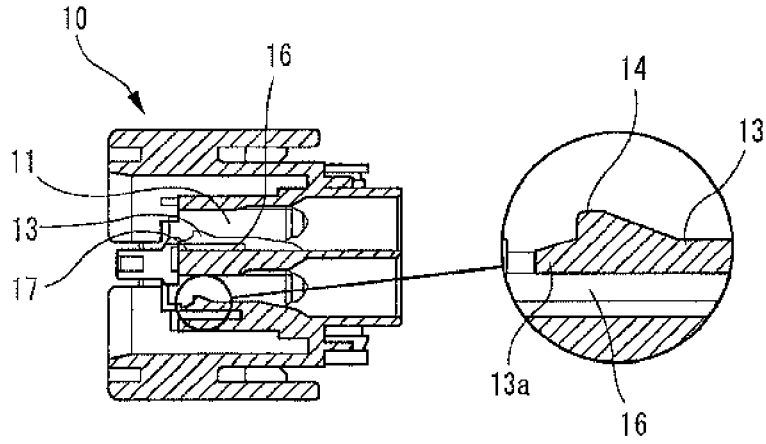
Fig. 7A Prior Art
Figure 7B:
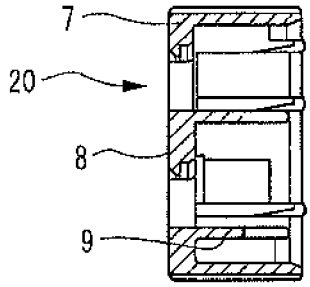
Fig. 7B Prior Art
Figure 7C:
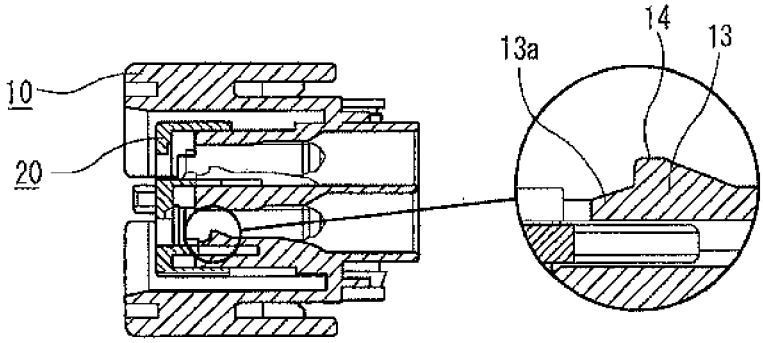
Fig. 7C Prior Art
Figure 8:
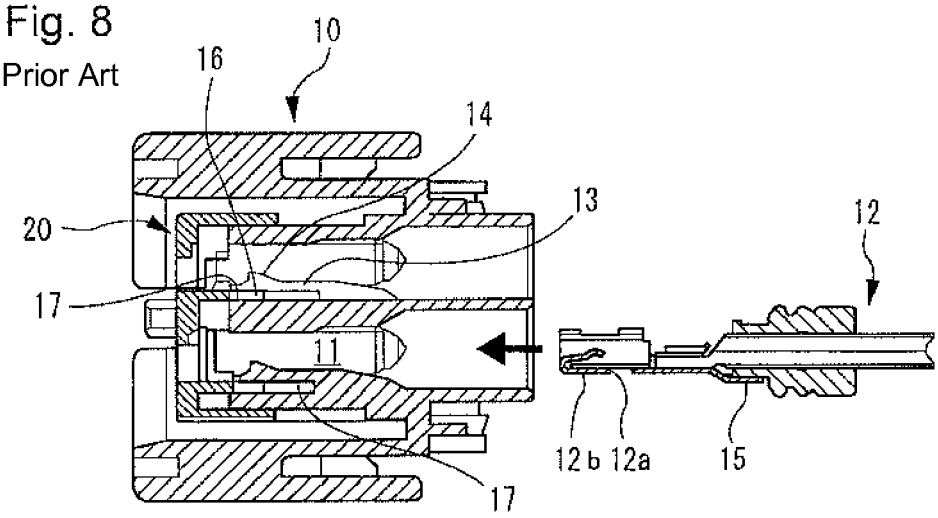
Fig. 8 Prior Art
FIG. 8 is a sectional view showing a state before a terminal is inserted into the conventional connector assembly.
Figure 9:
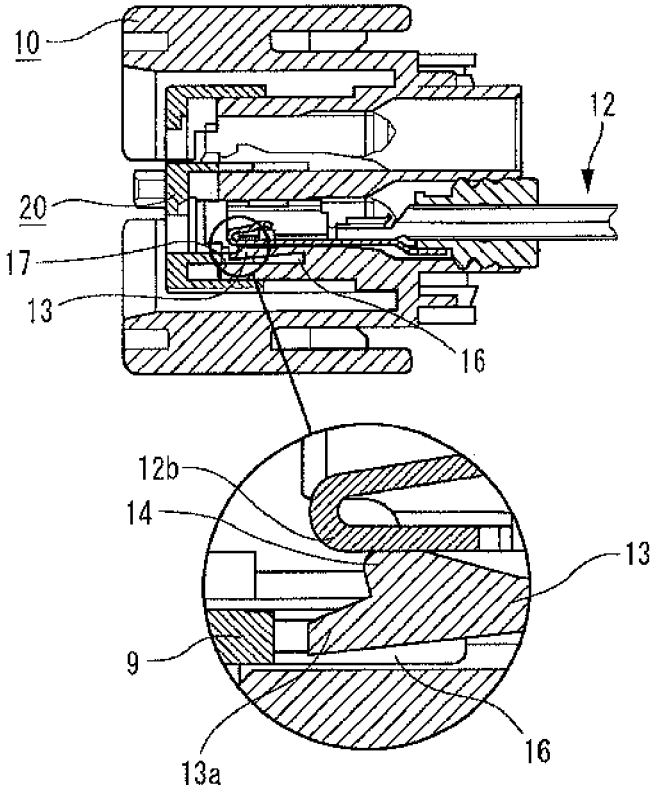
Fig. 9 Prior Art
FIG. 9 is a sectional view showing a state where the terminal is incompletely inserted into the conventional connector assembly.
Figure 10:
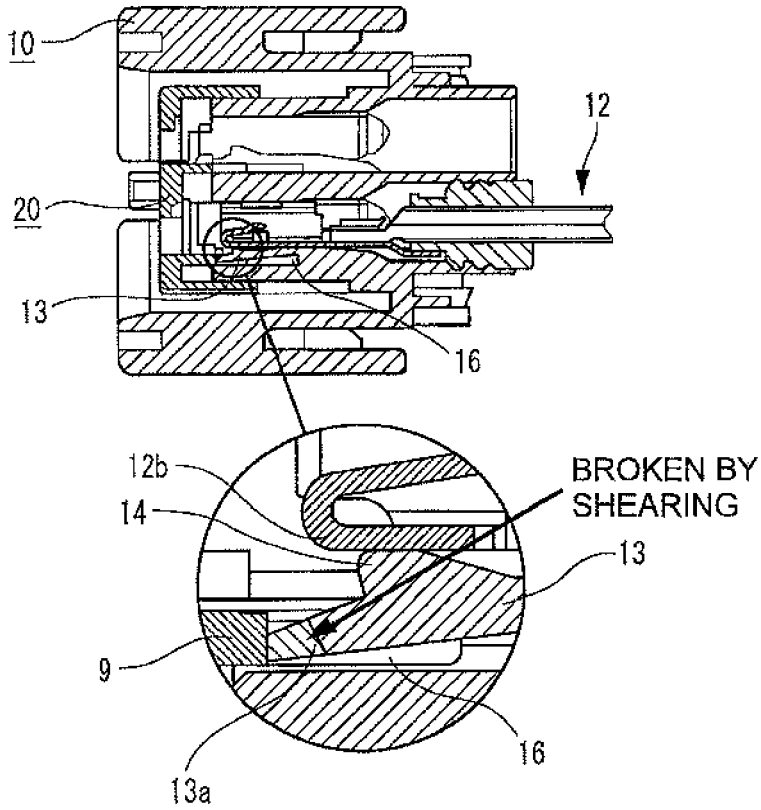
Fig. 10 Prior Art
FIG. 10 is a sectional view showing another state where the terminal is incompletely inserted into the conventional connector assembly.

On the other hand, in case where the terminal 12 is in the incompletely inserted state, the projected part 51 which is introduced into the terminal containing room 46 overrides the contact face 41*c* of the lance beak part 43, while the vertical face 54*b* of the projected part 51 is not brought into contact with the upright distal end face 41*b* of the lance beak part 43 of the deflected locking lance 41, and the lower face 54*a* of the projected part 51 slides along the contact face 41*c* of the lance beak part 43 of the locking lance 41 (See FIG. 5). Thereafter, the vertical face 54*b* of the projected part 51 comes into contact with the vertical face 41*d* which defines the locking projection 42 of the locking lance 41, as shown by a dotted line in an encircled region in FIG. 6. The worker recognizes whether the terminal 12 is in the completely inserted state or in the incompletely inserted state, by sensing a strike of the vertical face 54*b* of the projected part 51 against the vertical face 41*d* of the locking lance 41.

As described above, in the embodiment according to the invention, in case where the front holder 50 is engaged with the connector housing 40 while the terminal 12 is in the incompletely inserted state, the projected part 51 will not strike the upright distal end face 41*b* of the lance beak part 43 positioned at the distal end of the deflected locking lance 41, but strikes the vertical face 41*d* defining the locking projection 42 which has a larger wall thickness than the lance beak part 43. Because the projected part 51 strikes the locking projection 42 which is more rigid due to its large wall thickness, it is possible to restrain the distal end of the locking lance 41 from being broken, as compared with the case where the projected part 51 strikes the lance beak part 43.

Moreover, because the lower face 54*a* of the projected part 51 slides along the contact face 41*c* of the lance beak part 43 of the locking lance 41 and overrides the contact face 41*c* of the lance beak part 43, it is possible to guide the vertical face 54*b* of the projected part 51 to the vertical face 41*d* of the locking lance 41, while an external force to be exerted on the lance beak part 43 when the projected part 51 gets in touch with the lance beak part 43 is depressed to the least. In this manner, it is possible to restrain the lance beak part 43 from being broken. This effect is most prominent in case where the lower face 54*a* of the projected part 51 comes into face contact with the contact face 41*c* of the lance beak part 43.

It is apparent that the invention is not limited to the above described embodiment, but modification, improvement and so on can be appropriately made. Moreover, materials, shapes, sizes, numbers, positions to be arranged, and so on of the constituent elements in the above described embodiment are not limited, but can be optionally selected, provided that the invention can be attained.

This application is based upon and claims the benefit of priority of Japanese Patent Application No. 2009-229573 filed on Oct. 1, 2009, the contents of which are incorporated herein by reference.

REFERENCES SIGNS LIST

12 Terminal
30 Connector
40 Connector housing
41 Locking lance
41*b* Upright distal end face
41*c* Contact face
41*d* Vertical face
42 Locking projection
43 Lance beak part
44 Deflection space
45 Insertion part
50 Front holder
51 Projected part
54*a* Lower face
54*b* Vertical face

The invention claimed is:

1. A connector, comprising a connector housing having a flexible locking lance that locks a terminal to be inserted in the connector housing, and a deflection space that allows deflection of the locking lance; and a front holder having a projected part that is inserted into the deflection space in a direction opposite to the insertion direction of the terminal, wherein an distal end of the locking lance is provided with a lance beak part and a locking projection that is continued from the lance beak part and erected from a terminal end of the lance beak part; and wherein when the projected part is inserted into the deflection space in a state where the locking lance is deflected, a lower face of the projected part overrides a contact face of the lance beak part, and a distal end of the projected part comes into contact with a vertical face of the locking projection which is erected from the lance beak part.

2. The connector as claimed in claim 1, wherein an inclined face which is tapered toward the distal end of the locking lance is formed on the contact face of the lance beak part, and an inclined face which is tapered toward the distal end of the projected part is formed on the lower face of the projected part.

3. The connector as claimed in claim 2, wherein when the lower face of the projected part overrides the contact face of the lance beak part, the lower face of the projected part comes into face contact with the contact face of the lance beak part.

* * * * *